United States Patent [19]

Shapiro

[11] Patent Number: 4,792,032

[45] Date of Patent: Dec. 20, 1988

[54] MECHANICAL TIMING DEVICE ELECTRONIC UPGRADING MECHANISM

[75] Inventor: Sol Shapiro, Willowdale, Canada

[73] Assignee: Systron Electronic Systems Inc., Downsview, Canada

[21] Appl. No.: 879,341

[22] Filed: Jun. 27, 1986

[51] Int. Cl.[4] ..... G07F 5/10

[52] U.S. Cl. ..... 194/243; 194/216; 194/219; 194/239; 368/90

[58] Field of Search ..... 194/216, 219, 239, 243, 194/302, 334, 337; 368/90, 91, 92; 133/3 R, 3 E; 453/3

[56] References Cited

U.S. PATENT DOCUMENTS

| | | | |
|---|---|---|---|
| 974,035 | 10/1910 | Davis | 194/243 |
| 1,799,056 | 3/1931 | Miller et al. | 194/293 |
| 2,603,288 | 7/1952 | Sollenberger | 194/227 X |

FOREIGN PATENT DOCUMENTS

| | | | |
|---|---|---|---|
| 0001976 | 5/1979 | European Pat. Off. | 194/219 |
| 2804085 | 8/1978 | Fed. Rep. of Germany | 368/90 |
| 2077475 | 12/1981 | United Kingdom | 368/90 |
| 8100778 | 3/1981 | World Int. Prop. O. | 368/90 |

*Primary Examiner*—Joseph J. Rolla
*Assistant Examiner*—Edward S. Ammeen
*Attorney, Agent, or Firm*—Ivor M. Hughes

[57] ABSTRACT

An electronic upgrading mechanism for upgrading a mechanical timing device comprising an electrical coin sensing mechanism which is installed abutting a coin carrier mechanism of a mechanical timing device for detection of actuation of a clock winding lever in communication with a coin carriage of the coin carrier mechanism; wherein the actuation of the clock winding lever is caused by a coin placed in the coin carriage wound into primary contact with alternative abutting cam surfaces such abuttal thereof providing an electrical contact with the electrical coin sensing mechanism, having at least one compatible contact thereon, each contact dedicated to the denomination of a coin; wherein the electrical coin sensing mechanism communicates with a programmable electronic digital timing control and display device which is installed within an upgraded mechanical timing device thereby replacing clocking and flagging mechanisms of the mechanical timing device.

10 Claims, 4 Drawing Sheets

MECHANICAL TIMING DEVICE ELECTRONIC UPGRADING MECHANISM

FIELD OF INVENTION

This invention relates to the technical field of coin operated timing devices and more specifically to vehicle parking meters and like devices responsive to the insertion of a coin which control and indicate intervals of time elapsed and which provide visual digital reading of remaining time and a warning signal when the allowed time has expired.

BACKGROUND OF THE INVENTION

It is known in the prior art of coin operated mechanical timing devices to collect deposited coins as payment for using such as a vehicle parking space, to audit and display remaining time allowed for legitimate parking, and to provide a warning sign when parking violation occurs. (For example, such devices are known as parking meters.)

A typical and widely known type of a mechanical parking meter is the Ducan type of parking meter (Ducan is a registered trade mark of Duncan Industries, a division of Qonaar Corporation of Elkgrove Village, Ill.).

Existing types of mechanical timing devices have approximately equal function and consist of similar components comprising, a mechanical timer, containing a mechanical clock and a clock winding device; a ratcheted coin carrier mechanism containing a coin carriage with a winding pawl, a mechanical coin validating system to accept and handle the deposited coins; and a pointing and flagging mechanism to display on a dial the remaining time and to provide warning signals when violating conditions occur. Such mechanisms are described in U.S. Pat. Nos. 1,799,056 and 2,603,288, the teachings of which are hereby incorporated by reference, specifically the teachings of which include the state of the art.

The mechanical types of meters have a number of shortcomings due to their mechanical nature, which cannot be overcome within the known art, said shortcomings being the complexity and high cost of changing the parking time and rate parameters; the inaccuracy and relatively low reliability of the mechanical clock mechanism, caused by dirt deposition, vibration, shocks, wear and tear; the malfunctions of the coin validating and clock winding mechanisms and cam surfaces caused by wear and tear; and inherent mechanical limitations which preclude implementation of more sophisticated but practical and useful functions like dual time rate or split time rate available within electronic timing devices. These shortcomings can be overcome by eliminating the mechanical clock and winding and flagging means associated with it, as the most vulnerable parts, and replacing them with a programmable electronic digital timing controller and comprehensive digital time and flag displays without any moving parts or components.

Further, complete replacement of the mechanical timing devices with electronic timing devices is very expensive and inefficient as one is left with a large inventory of redundant devices within which one may have a considerable investment.

However, in spite of all the aforementioned teachings, a void currently exists within the technology of timing devices that provides for the conversion of a mechanical timing device to an electronic timing device thereby retaining the capital previously invested therein, eliminating costly conversion thereto, and providing all of the desireable digital functions available within the art.

It is therefore an object of this invention to provide a digital electronic timing device conversion kit that will convert a mechanical timing device to a programmable electronic device using the existing housing and coin carrier mechanism of the mechanical device but eliminating the most vulnerable mechanical components therein normally subjected to wear, such as the mechanical clock, the winding mechanism and the flagging mechanism.

It is a further object of this invention to provide such a kit that is easy to install and maintain.

It is still a further object of this invention to provide such a kit that will render the resulting device programmable and reliable even at temperature extremes.

It is a further object of this invention to eliminate the inefficient process of modernization by providing a kit that is fully compatible with the mechanical housings of existing time devices.

Further and other objects of this invention will become apparent to a man skilled in the art when considering the following summary of the invention and the more detailed embodiments of the invention illustrated herein.

SUMMARY OF THE INVENTION

A timing device incorporating electronic upgrading means is provided, the timing device having alternative abutting cam surfaces, a clock winding lever, and a coin carriage mechanism, the timing device comprising an electrical coin sensing means which is installed abutting a coin carrier mechanism of the timing device for detection of actuation of a clock winding lever in communication with a coin carriage of said coin carrier mechanism; wherein the actuation of said clock winding lever is caused by a coin placed in said coin carriage to be wound into contact with the alternative abutting cam surfaces disposed within the timing device, such abutment of a coin and the alternative abutting cam surfaces providing an electrical contact with said electrical coin sensing means, the coin sensing means having at least one compatible contact thereon, each contact dedicated to the denomination of a coin; wherein said electrical coin sensing means communicates with a programmable electronic digital timing control and display device, whereby the electronic upgrading means is installed within the upgraded timing device thereby providing clocking and flagging functions within said timing device.

In a preferred embodiment a parking meter incorporating electronic upgrading means said parking meter having a coin carriage mechanism, a winding pawl, and alternative abutting cam surfaces is provided the upgrading means comprising an electrical coin sensing means which is installed on the coin carrier mechanism of the parking meter for detection of actuation of a clock winding pawl in communication with a coin carriage of said coin carrier mechanism; wherein the actuation of said clock winding pawl is caused by a coin placed in said coin carriage wound into primary contact with the alternative abutting cam surfaces, such abutment of a coin and the alternative abutting cam surfaces providing an electrical contact with said electrical coin sensing means, the coin sensing means having at least one compatible contact thereon, each contact dedicated to the denomination of a coin; wherein said electrical coin sensing means communicates with a programmable electronic timing control and display device, which is installed within said parking meter thereby providing clocking a flagging functions within said parking meter.

According to another aspect of the invention a coin carriage position detecting means may be installed abutting the coin carrier mechanism for detection of the position of the coin carriage of the coin carrier mechanism; said coin carriage position detecting means being in communication with the programmable digital control and display device.

In a preferred embodiment, the programmable electronic digital timing control and display device, for installation within a parking meter a mechanical parking meter, and comprises an impulse generating means for producing time reference clock impulses for separate outputs and time counting clock impulses, coin value type storing means for memorizing value type of the actuating coin, an impulse dosing means for generating a number of electrical impulses proportional to the value of the actuating coin; a switching time rate presetting means for binary digital coding of a period of time assigned per coin of least acceptable value; a digital adding means for summing of a pre-set time rate and remaining parking time, a switching time limit presetting means for binary digital coding of a maximum time limit within which the parking meter can operate; a digital magnitude comparing means for comparing the remaining parking time with the pre-set maximum time limit and generating an electrical signal, when the remaining parking time is larger or equal in relation to the pre-set time limit, a digital multiplexing means receiving said electrical signal from said magnitude comparing means for switching either the pre-set maximum time limit, or the value from said digital adding means, a digital time down-counting means for storing and decrementing the remaining parking time; a displaying means for conversion of digital binary codes and signals into visual images for displaying remaining parking time and a warning signal and enabling means.

According to another aspect of the invention a timing device incorporating electronic upgrading means is provided, the timing device having a coin track, having alternative abutting cam surfaces on said coin track, and a clock winding pawl carried by a coin carriage mechanism of a coin carrier mechanism, the timing device further comprising a pressure sensitive means which is spaced from the cam surfaces a first distance and spaced from the coin track a second distance for detection of actuation of said clock winding pawl carried by the coin carriage mechanism of said coin carrier mechanism; the cumulative dimension of the diameter of a coin and the winding pawl, being greater than said first distance and less than said second distance, wherein the actuation of said clock winding pawl is caused by a coin placed in said coin carriage mechanism and wound into contact with the alternative abutting cam surfaces disposed within the timing device, such abutment of the coin and the alternative abutting cam surfaces raising the winding pawl and providing a pressure contact between said winding pawl and said pressure sensitive means, the coin sensing means having at least one contact thereon, each contact dedicated to the denomination of a coin; wherein said pressure sensitive means is connected to a programmable electronic digital timing control and display device, whereby the electronic upgrading means which is installed within the timing device thereby provides clocking and flagging functions within said timing device.

According to another aspect of the invention, a parking meter incorporating electronic upgrading means is provided, said parking meter having a coin carrier mechanism, a winding pawl, a coin track and alternative abutting cam surfaces on said coin track, the upgrading means comprising a pressure sensitive means which is spaced from the cam surfaces a first distance and spaced from the coin track a second distance for detection of actuation of said clock winding pawl carried by the coin carriage mechanism of said coin carrier mechanism, the cumulative dimension of the diameter of a coin and the winding pawl, being greater than said first distance and less than said second distance, wherein the actuation of said clock winding pawl is caused by a coin placed in said coin carriage mechanism wound into contact with the alternative abutting cam surfaces, said abutment of the coin and the alternative abutting cam surfaces raising the winding pawl and providing a pressure contact between said winding pawl and said pressure sensitive means, the coin sensing means having at least one contact thereon, each contact dedicated to the denomination of a coin; wherein said pressure sensitive means is connected to a programmable electronic timing control and display device, which is installed within said parking meter thereby provides clocking and flagging functions within said parking meter.

DETAILED DESCRIPTION OF THE DRAWINGS

Figure 1:
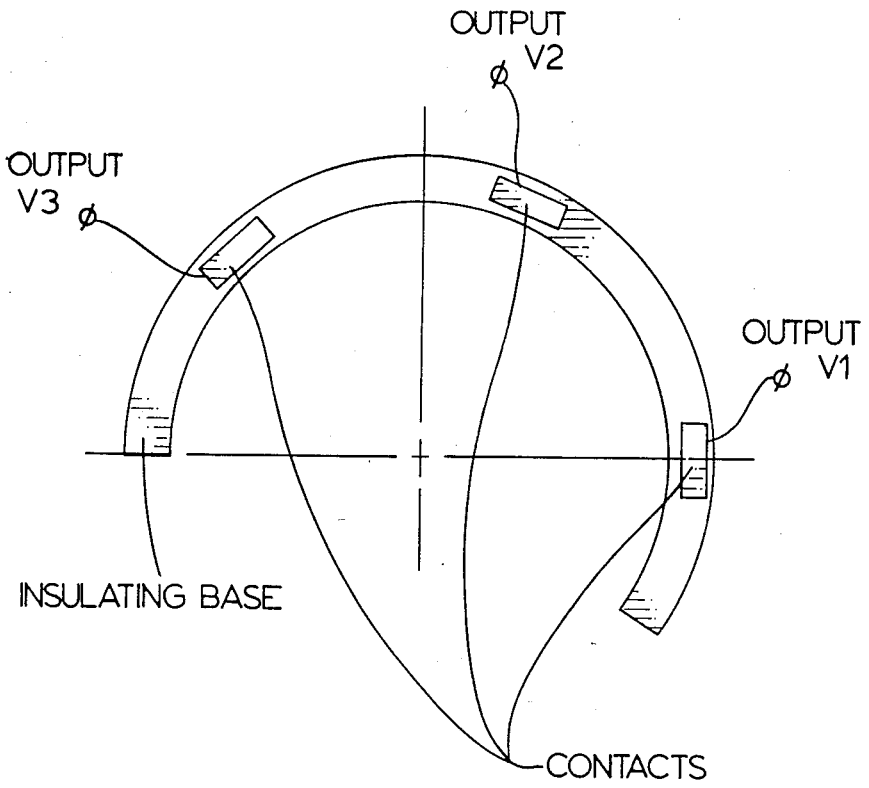
FIG. 1 is a front view of the electrical coin sensing means in a preferred embodiment of the invention.

Referring to FIG. 1, the electrical coin sensing means is illustrated in a preferred embodiment of the invention depicting a sensing device with attached electrical contacts, which are to be connected to the inputs of an electronic control display unit. The coin sensing means in a preferred embodiment of the invention is shaped in the form of an arch in order to allow its installation in a coin carrier mechanism of such as a mechanical parking meter and to set contacts along the operating trajectory of the coin carriage containing a clock winding pawl.

Figure 2:
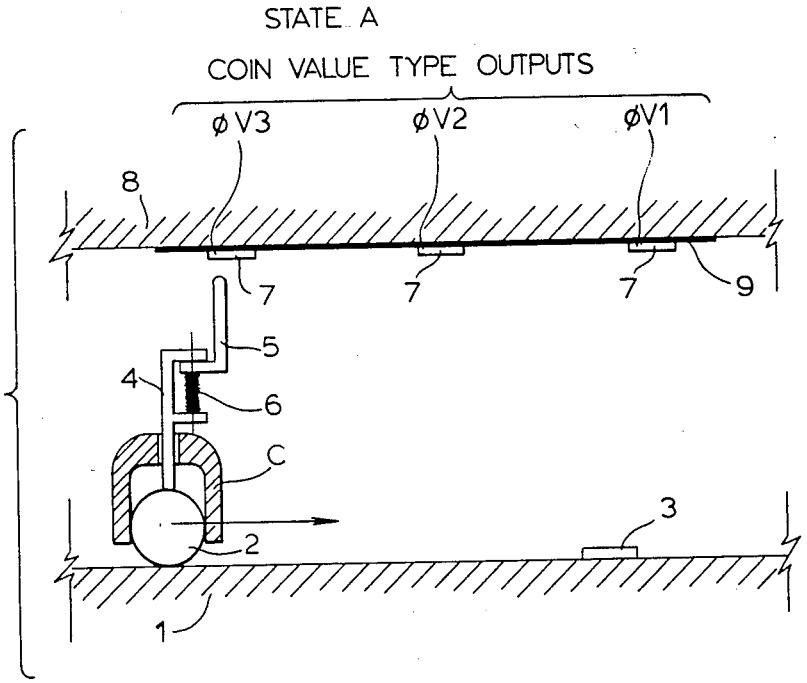
FIG. 2 is a view illustrating two alternative position sensing means in communication with the coin carriage means in a preferred embodiment of the invention.
Figure 2:
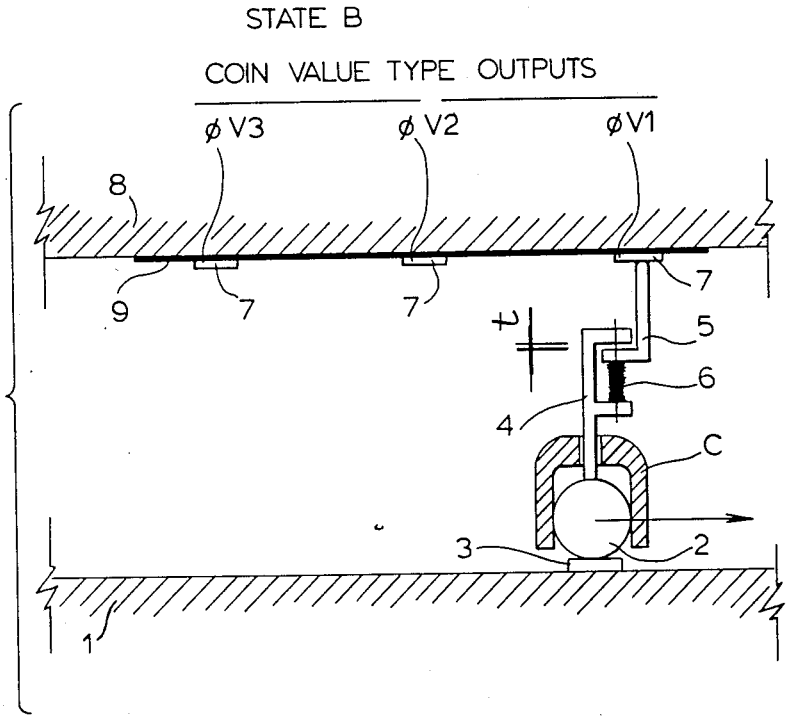
Figure 2A:
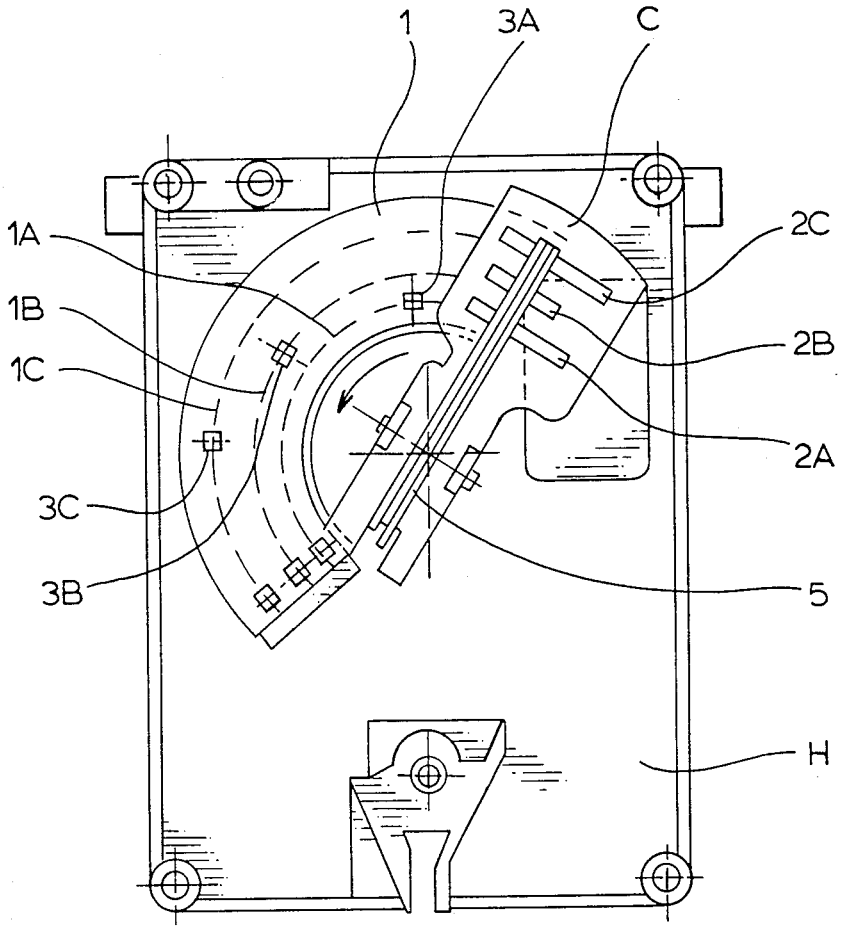
FIG. 2A is a plan view of a coin track with alternative cams installed on the coin paths dedicated to each type of coin denomination and a coin carriage incorporating a mechanical clock winding pawl and multiple coin denomination slots.

Referring now to FIGS. 2 and 2A, the coin sensing means and arrangement of the coin track with alternative coin cams is illustrated in a preferred embodiment of the invention depicting a coin sensing means installed on a coin carrier mechanism of a mechanical parking meter.

The basic mechanical coin carrier mechanism on which the coin detecting means is installed, essentially consists of a coin track 1 serving to support and to guide the coin 2 when said coin is carried by the coin carriage C on the coin track along the alternative coin path 1A, 1B or 1C toward the alternative coin validating cam 3A, 3B or 3C. Selection of the particular coin path is determined by the coin denomination placed in the coin carriage C in either slot 2A, slot 2B or slot 2C. The coin validating cam, serves to lift the coin a height sufficient to provide touching between the winding pawl 5 and the sensing contact 7; said winding pawl 5, serving to provide physical contact with the sensing contact 7, when the coin 2 is placed on the coin validating cam 3. A coin extension pawl 4 is fastened thereto serving to press the coin to the coin track 1 and to pass the size of the coin 2 to the winding pawl 5, further containing a spring 6, serving to provide elasticity to the mechanical coupling of the coin extension pawl 4 and the winding pawl 5, said carriage disposed upon a base 8 which is at fixed distance with reference to the coin track 1 and serves as a measuring reference. A ratchet mechanism is not shown in FIG. 2 and will not be discussed herein since it does not have direct relation to the coin detecting means functioning within the preferred embodiment of the invention. The coin detecting means 9 is attached to the base 8 facing the coin carriage C by its sensing contacts 7 and lined up with the operating trajectory of the winding pawl 5.

Referring to FIG. 2, State A, the coin 2 is carried along the coin track 1, being pressed to the coin track by the coin extension pawl 4. Said coin extension pawl is coupled with the winding pawl 5 by the spring 6 by way that the assembly, consisting of said parts 4, 5, and 6 cannot increase its combined length, however may be elastically compressed when it is pressed along the winding pawl 5. The base 8, carrying the coin detecting means 9, is placed above the winding pawl 5 at such a distance, that said winding pawl cannot reach the level of surface of the sensing contacts 7, while the coin 2 is sitting on the coin track 1.

Referring to FIG. 2, state B, the validating cam 3 of certain height is installed on the coin track 1 in the area where the sensing contact 7 is located. When the coin 2 is elevated on the validating cam 3, the winding pawl 5 will be lifted by the coin via the extension pawl 4, and if the diameter of the coin is large enough, then the winding pawl 5 will touch the sensing contact 7 with the pressing force, provided by the compressing of the spring 6 on value t. The actual minimal validating tolerance in this case will be t.

An alternative embodiment of the disclosed coin validating device is provided wherein instead of the sensing contact 7 a pressure sensitive substance is applied, for example, a piezo electric crystal. In this embodiment, when the winding pawl 5 presses said piezo electric crystal it will generate electromotive force, which will be percieved by the input of the electronic control display unit.

Further, the validating tolerance on the diameter of the coin is improved significantly, since in the prior art the minimum tolerance achievable is determined by the requirements of the minimum area of overlap between the winding pawl 5 and the cogs of the winding mechanism, whereas in the proposed device the minimum achievable validating tolerance t (FIG. 2) is limited only by the rate of linear compression of the spring 5, required to provide sufficient contact pressure between the winding pawl 5 and the sensing contact 7. Such a linear compression may be close to a negligible value.

Figure 3:
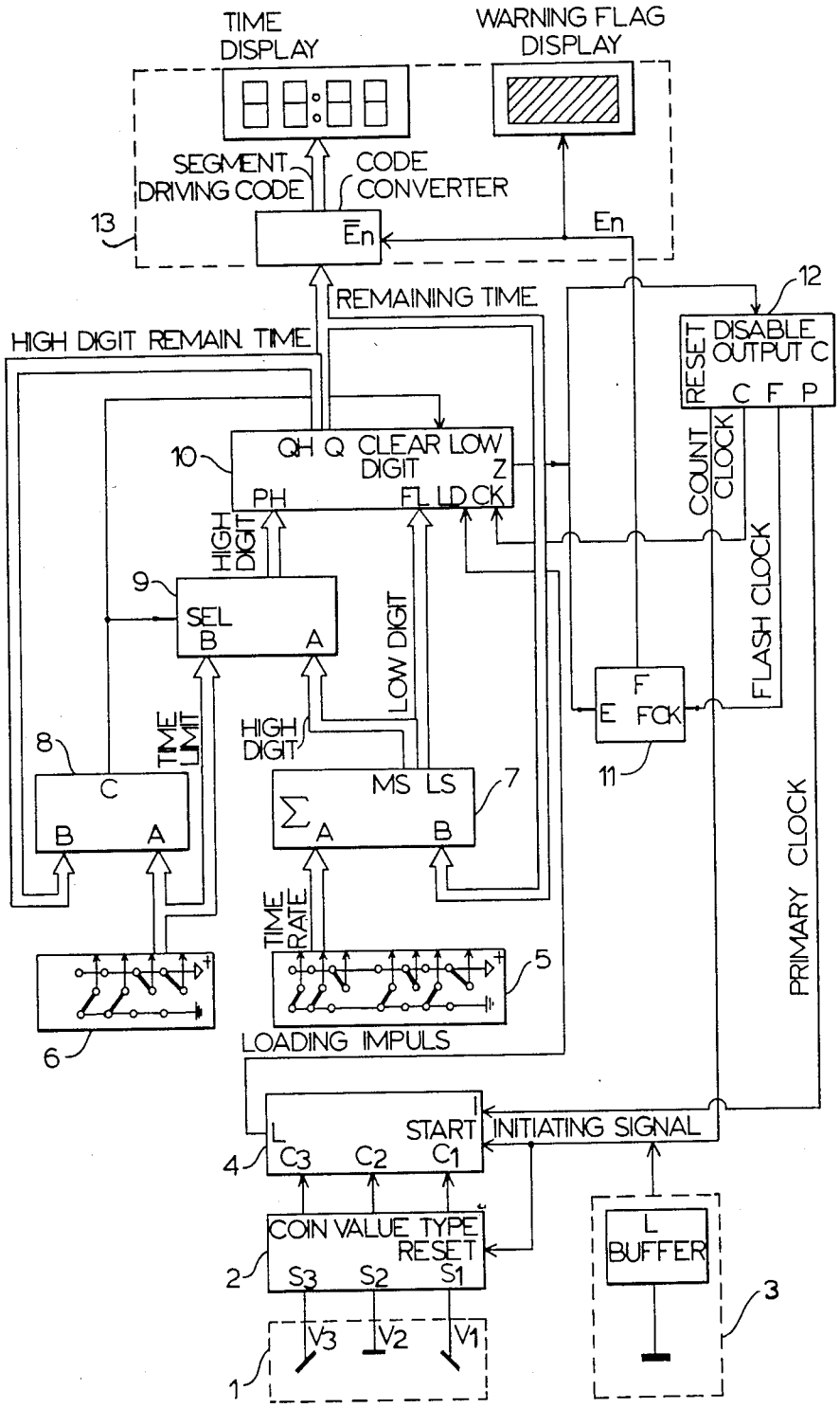
FIG. 3 is a logic block diagram of the electronic digital control display unit in a preferred embodiment of the invention.

Referring to FIG. 3, the functional principles of the digital electronic control display unit is illustrated in form of a block diagram. The block diagram of the invention disclosed herein includes a coin detecting means 1, a coin type storing means 2, a coin carriage position detecting means 3, an electrical impulse dosing means 4, a programmable time rate setting means 5, a programmable time limit setting means 6, a digital adding means 7, a digital magnitude comparing means 8, a digital multiplexing means 9, a digital down-counting means 10, a display controlling means 11, a clock impulse supply 12, and a numerical displaying means 13.

The system runs on a reference clock from the clock impulse supply 12 which provides a primary fast clock from the output P with frequency, for instance 128 Hz, a flashing reference clock from the output F with the frequency range required for the visual flashing of the numerical displays, for instance two seconds, and a time counting clock from the output C with the frequency range required for the parking time counting, for instance one minute.

When a coin is detected by the coin detecting means 1, said coin detecting means provides an electrical signal on one of its outputs, dedicated to this particular type of coin value. The outputs of said coin detecting means are connected to inputs S of the coin type storing means 2, where the state of the activated input is internally latched.

When the coin carriage arrives to a location where the coin carriage position detecting means 3 is installed, said detecting means, which is an electrical contact pulled up to some electrical potential will touch the coin carriage, and will provide an electrical signal on its output L. This signal initiates a cycle of incrementing parking time by a value, which is defined by the denomination of the detected coin. Simultaneously the initiating signal resets to zero the coin type storing means 2 and the clock impulse supply 12. The impulse dosing means 4 receives on its control inputs C information of the type of detected coin and on its clock input I, the primary fast clock. The pulse dosing means 4 upon receiving the initiating signal on its start input from the coin carriage position detector 3, selects from the primary clock a number of loading pulses, proportional to the coin value, for instance: one impulse for five cents, two impulses for ten cents, five impulses for twenty-five cents. Since the clock impulse supply 12 is reset by said initiating signal, the initial state of generating loading pulses is kept constant, which provides conditions required for reliable pulse selecting process.

The digital adding cycle sequence occurs as follows: There are two programming means which are employed in the control display unit. They are a time rate setting means 5 and a time limit setting means 6. Both of them are formed by a group of switching means, each of which can be tied either to low or to high electrical potential in order to represent binary symbols '0' or '1'.

The time limit setting means 6 is structured in such a way that binary combination of its outputs expresses the maximum time that can be loaded into the digital timer.

The time rate setting means is structured in such a way that binary combination of its outputs expresses the time per coin of the least acceptable value (for instance, number of minutes per five cents). The outputs of said time rate setting means are connected to the set of adding inputs A of the adding means 7. The set of adding inputs B of said adding means is connected to the outputs of the digital down-counting means 10.

The digital outputs S of said digital adding means are split into two parts: the most significant portion MS and the least significant portion LS of the sum. The least significant portion of the sum, which represents for instance minutes and tens of minutes is connected to the low order part PL of the pre-set inputs of the down-counting means 10.

The most significant portion of the sum, which represents, for instance hours, is connected to the digital input A of the multiplexing means 9. Another digital multiplexing input B of said multiplexing means is connected to outputs of the programmable time limit setting means 6. Said digital multiplexing means allows the high order portion PH of the inputs of the down-counting means 10 to be loaded either from the adding means 7 or from the time limit setting means 6, depending on state of an output of the digital magnitude comparing means 8.

Said magnitude comparing means performs comparing of the numbers friom the time limit setting means 6 and the high order portion QH of the remaining parking time from the time down-counting means 10. As long as the high order portion of the remaining parking time is less than the pre-set time limit, the multiplexing means 9 allows loading the time down-counting means 10 from the adding means 7. As soon as the remaining parking time on the time down-counting means becomes larger or equal in relation to the pre-set maximum time limit, the magnitude comparing means 9 generates an electrical signal from its output C, and switches the multiplexing means 9, forcing loading of said down-counting means with a number from the time limit setting means 6 and clearing the least significant portion of the outputs of the down-counting means 10. Therefore, the magnitude of the remaining parking time can never exceed the pre-set time limit.

The loading impulse from the output L of said pulse dosing means 4, being connected to the loading input LD of the down-counting means 10, loads a number by its leading edge from the output of said multiplexing means 9 and from the adding means 7 into the time down-counting means 10, producing updated remaining parking time on the output of said down-counting means. The updated remaining parking time again returns to the input of said adding means 7 and is summed with the time rate from said time rate setting means 5. This new sum appears on the input of said down-counting means 10. Next loading impulse will repeat the previously described process and each loading impulse will cause incrementing of the remaining parking time on the value, fixed in the time rate setting means 5. Therefore, since said pulse dosing means 4 generates a number of impulses proportional to the value of the actuating coin, and since said time rate setting means 5 holds the parking time per the least valued coin, the remaining parking time on said time down-counting means will be updated according to the value of the actuating coin.

When the time down-counting means 10 is not in state of the time updating it counts down the remaining parking time with the clock rate, provided by the time counting clock 12 on the input CK of said down-counting means.

When the remaining parking time on said time down-counting means reaches zero, the down-counter 10 generates electrical potential from a zero indicating output Z. This electrical potential disables the time counting clock on the clock impulse supply 12 and activates the display controlling means 11 through the enable input E. As a result the remaining parking time on the time down-counting means will stay at zero and said display controlling means will be activated and will start generating pulsing voltage from its output F with the frequency, equal to the flashing reference clock from the output F of the clock impulse supply 12. As a result, the numerical display means 13 will be forced through its enable input En to a flashing mode and will exhibit flashing zeros.

The numerical displaying means 13 consists of visual numerical displays (for instance 7 segment numerical displays) and converting means to convert the digital outputs from the time down-counting means into a form adaptable by the numerical displays (for instance 7 segment code).

Said numerical displaying means contains a single input on-off displaying element such as a liquid crystal display, performing the function of a warning flag. As long as the display controlling means 11 is not activated, said warning flag is held under disabling electrical potential, which keeps it in blank state, but it starts flashing, following pulsing voltage on its enabling input En from the activated display controlling means 11.

A very important functional feature of the control display unit described herein is that the unit performs all functions required for parking meters without employing any moving mechanical parts.

As many changes can be made to the embodiment without departing from the scope of the invention, it is intended that all material contained herein by interpreted as illustrative of the invention and not in a limiting sense.

The embodiments of the invention in which an exclusive property or privilege is claimed are as follows:

1. A timing device incorporating electronic upgrading means the timing device having a coin track, having alternative abutting cam surfaces on said coin track, and a clock winding pawl carried by a coin carriage mechanism of a coin carrier mechanism, the timing device further comprising an electrical coin sensing means which is spaced from the cam surfaces a first distance and spaced from the coin track a second distance for detection of actuation of said clock winding pawl carried by the coin carriage mechanism of said coin carrier mechanism; the cumulative dimension of the diameter of a coin and the winding pawl, being greater than said first distance and less than said second distance, wherein the actuation of said clock winding pawl is caused by a coin placed in said coin carriage mechanism and wound into contact with the alternative abutting cam surfaces disposed within the timing device, such abutment of the coin and the alternative abutting cam surfaces raising the winding pawl and providing an electrical contact between said winding pawl and said electrical coin sensing means, the coin sensing means having at least one contact thereon, each contact dedicated to the denomination of a coin; wherein said electrical coin sensing means is connected to a programmable electronic digital timing control and display device, whereby the electronic upgrading means which is installed within the timing device thereby provides clocking and flagging functions within said timing device.

2. A parking meter incorporating electronic upgrading means said parking meter having a coin carrier mechanism, a winding pawl, a coin track and alternative abutting cam surfaces on said coin track, the upgrading means comprising an electrical coin sensing means which is spaced from the cam surfaces a first distance and spaced from the coin track a second distance for detection of actuation of said clock winding pawl carried by the coin carriage mechanism of said coin carrier mechanism, the cumulative dimension of the diameter of a coin and the winding pawl, being greater than said first distance and less than said second distance, wherein the actuation of said clock winding pawl is caused by a coin placed in said coin carriage mechanism wound into contact with the alternative abutting cam surfaces, such abutment of the coin and the alternative abutting cam surfaces raising the winding pawl and providing an electrical contact between said winding pawl and said electrical coin sensing means, the coin sensing means having at least one contact thereon, each contact dedicated to the denomination of a coin; wherein said electrical coin sensing means is connected to a programmable electronic timing control and display device, which is installed within said parking meter thereby providing clocking the flagging functions within said parking meter.

3. The device of claim 1 or 2 including said programmable electronic digital timing control and display device, for installation within a parking meter, comprising an impulse generating means for producing time reference clock impulses on separate outputs and time counting clock impulses; a coin value type storing means for memorizing the value type of an actuating coin, said coin value type storing means being connected to said coin sensing means and a coin carriage position detecting means; an impulse dosing means for generating a number of electrical impulses proportional to the value of the actuating coin, said impulse dosing means being connected to said coin value type storing means, a primary clock, and said coin carriage position detecting means; a switching time rate presetting means for binary digital coding of a period of time assigned per a coin of least acceptable value; a digital adding means for summing of the pre-set time rate and remaining parking time, said digital adding means being connected to said time rate presetting means and a time down-counting means for storing and decrementing the remaining parking time; a switching time limit presetting means for binary digital coding of a maximum time limit within which the parking meter can operate; a digital magnitude comparing means for comparing the remaining parking time with the pre-set maximum time limit and generating an electrical signal when the remaining parking time is larger or equal in relation to the pre-set time limit; a digital multiplexing means receiving said electrical signal from said magnitude comparing means for switching either the pre-set maximum time limit, or the value from said digital adding means; a displaying means for conversion of digital binary codes and signals into visual images, for displaying remainging parking time and a warning signal; and a display controlling means, said display controlling means being connected to a display flashing clock and said time down-counting means for blanking and enabling the displaying means.

4. The device of claim 1 or 2 wherein said coin carrier mechanism is moveable along a path describing an arch and said coin sensing means is disposed within the arch compassing a compatibly shaped interior housing, in communication with the path described by the motion of said coin carrier mechanism.

5. The device of claim 3 wherein said coin carrier mechanism is moveable along a path describing an arch and said coin sensing means is disposed within the arch compassing a compatibly shaped interior housing, in communication with the path described by the motion of said coin carrier mechanism.

6. A timing device incorporating electronic upgrading means the timing device having a coin track, having alternative abutting cam surfaces on said coin track, and a clock winding pawl carried by a coin carriage mechanism of a coin carrier mechanism, the timing device further comprising a pressure sensitive means which is spaced from the cam surfaces a first distance and spaced from the coin track a second distance for detection of actuation of said clock winding pawl carried by the coin carriage mechanism of said coin carrier mechanism; the cumulative dimension of the diameter of a coin and the winding pawl, being greater than said first distance and less than said second distance, wherein the actuation of said clock winding pawl is caused by a coin placed in said coin carriage mechanism and wound into contact with the alternative abutting cam surfaces disposed within the timing device, such abutment of the coin and the alternative abutting cam surfaces raising the winding pawl and providing a pressure contact between said winding pawl and said pressure sensitive means, the pressure sensitive means having at least one contact thereon, each contact dedicated to the denomination of a coin; wherein said pressure sensitive means is connected to a programmable electronic digital timing control and display device, whereby the electronic upgrading means which is installed within the timing device thereby provides clocking and flagging functions within said timing device.

7. A parking meter incorporating electronic upgrading means said parking meter having a coin carrier mechanism, a winding pawl, a coin track and alternative abutting cam surfaces on said coin track, the upgrading means comprising a pressure sensitive means which is spaced from the cam surfaces a first distance and spaced from the coin track a second distance for detection of actuation of said clock winding pawl carried by the coin carriage mechanism of said coin carrier mechanism, the cumulative dimension of the diameter of a coin and the winding pawl, being greater than said first distance and less than said second distance, wherein the actuation of said clock winding pawl is caused by a coin placed in said coin carriage mechanism wound into contact with the alternative abutting cam surfaces, such abutment of the coin and the alternative abutting cam surfaces raising the winding pawl and providing a pressure contact between said winding pawl and said pressure sensitive means, the pressure sensitive means having at least one contact thereon, each contact dedicated to the denomination of a coin; wherein said pressure sensitive means is connected to a programmable electronic timing control and display device, which is installed within said parking meter thereby providing clocking and flagging functions within said parking meter.

8. The device of claim 6 or 7 including said programmable electronic digital timing control and display device, for installation within a parking meter, comprising an impulse generating means for producing time reference clock impulses on separate outputs and time counting clock impulses; a coin value type storing means for memorizing the value type of an actuating coin, said coin value type storing means being connected to said pressure sensitive means and a coin carriage positing detecting means; an impulse dosing means for generating a number of electrical impulses proportional to the value of the actuating coin, said impulse dosing means being connected to said coin value type storing means, a primary clock, and said coin carriage position detecting mens; a switching time rate presetting means for binary digital coding of a period of time assigned per a coin of least acceptable value; a digital adding means for summing of the pre-set time rate and remaining parking time, said digital adding means being connected to said time rate presetting means and a time down-counting means for storing and decrementing the remaining parking time; a switching time limit presetting means for binary digital coding of a maximum time limit within which the parking meter can operate; a digital magnitude comparing means for comparing the remaining parking time with the pre-set maximum time limit and generating an electrical signal when the remaining parking time is larger or equal in relation to the pre-set time limit, a digital multiplexing means receiving said electrical signal from said magnitude comparing means for switching either the pre-set maximum time limit, or the value from said digital adding means; a displaying means for conversion of digital binary codes and signals into visual images, for displaying remaining parking time and a warning signal; and a display controlling means for blanking and enabling the displaying means, said display controlling means being connected to a display flashing clock and said time down-counting means.

9. The device of claim 6 or 7 wherein said coin carrier mechanism is moveable along a path describing an arch and said pressure sensitive means is disposed within the arch compassing a compatibly shaped interior housing, in communication with the path described by the motion of said coin carrier mechanism.

10. The timing device of claim 6 or 7 wherein said pressure sensitive means further comprises piezo electric elements.

* * * * *